US007478490B2

(12) United States Patent
Segerljung

(10) Patent No.: US 7,478,490 B2
(45) Date of Patent: Jan. 20, 2009

(54) SECURING DEVICE

(75) Inventor: Max Segerljung, Vännäs (SE)

(73) Assignee: Stock of Sweden AB, Stromsund (SE)

( * ) Notice: Subject to any disclaimer, the term of this patent is extended or adjusted under 35 U.S.C. 154(b) by 186 days.

(21) Appl. No.: 10/521,142

(22) PCT Filed: Jul. 15, 2003

(86) PCT No.: PCT/SE03/01212

§ 371 (c)(1),
(2), (4) Date: Jan. 13, 2005

(87) PCT Pub. No.: WO2004/007851

PCT Pub. Date: Jan. 22, 2004

(65) Prior Publication Data

US 2005/0252048 A1 Nov. 17, 2005

(30) Foreign Application Priority Data

Jul. 15, 2002 (SE) ..... 0202205

(51) Int. Cl.
*E02F 3/96* (2006.01)

(52) U.S. Cl. ..... 37/468; 172/753; 172/272; 414/723

(58) Field of Classification Search ..... 37/403, 37/405, 468; 414/723, 912; 172/753, 439
See application file for complete search history.

(56) References Cited

U.S. PATENT DOCUMENTS 3,512,665 A * 5/1970 Westendorf ..... 414/723
3,672,521 A * 6/1972 Bauer et al. ..... 414/723
3,794,195 A * 2/1974 Clevenger et al. ..... 414/723
3,818,551 A * 6/1974 Coughran, Jr. ..... 403/24
4,085,856 A * 4/1978 Westendorf ..... 414/723
4,119,225 A * 10/1978 Macht et al. ..... 414/723
4,439,938 A * 4/1984 Grant ..... 414/723
4,545,720 A * 10/1985 Cochran et al. ..... 414/723
4,663,866 A * 5/1987 Karlsson et al. ..... 414/723
4,812,103 A * 3/1989 Cochran et al. ..... 414/723
4,850,790 A * 7/1989 Johnson et al. ..... 414/723
5,107,610 A * 4/1992 Fusco ..... 37/444
5,224,816 A * 7/1993 Kaczmarczyk et al. ..... 414/723

(Continued)

FOREIGN PATENT DOCUMENTS

SE 404 387 7/1977

*Primary Examiner*—Thomas B Will
*Assistant Examiner*—Jamie L McGowan
(74) *Attorney, Agent, or Firm*—Dilworth & Barrese LLP.

(57) ABSTRACT

A device is provided for attaching a first part in the form of an instrument or tool to a second part in the form of a beam or such on a working machine having, on each of the parts, one engagement member fixed thereto, which are designed to be driven into engagement with each other so that the force of gravity on the first part holds the parts attached to one another. A first (17) of the engagement members is of the male-type having external surfaces converging towards each other and a second of the engagement members is of the female-type having internal surfaces converging towards each other in a corresponding way to said surfaces of the first engagement means for receiving and holding the first engagement means in the second engagement means under the influence of the force of gravity on the first part.

27 Claims, 3 Drawing Sheets

U.S. PATENT DOCUMENTS 5,685,689 A * 11/1997 Schneider et al. ..... 414/723
5,743,339 A * 4/1998 Alexander, III ..... 172/272
5,836,734 A * 11/1998 Doering ..... 414/723
5,950,735 A * 9/1999 Godbersen ..... 172/439
6,347,671 B1 * 2/2002 Stiller et al. ..... 172/439

* cited by examiner

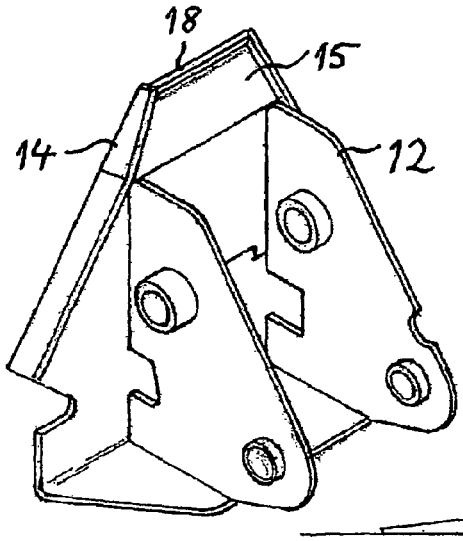
Fig 4
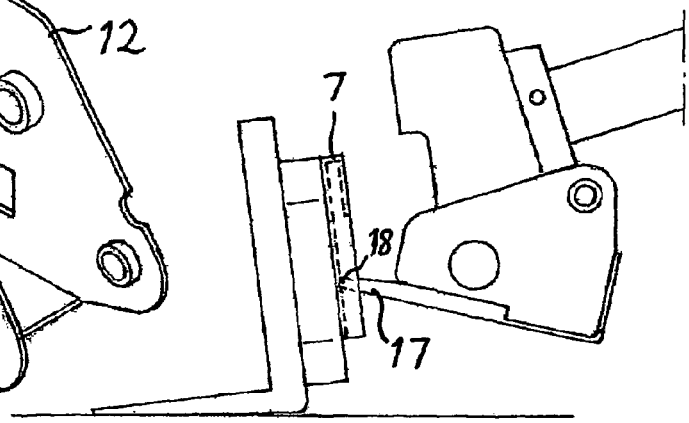
Fig 5
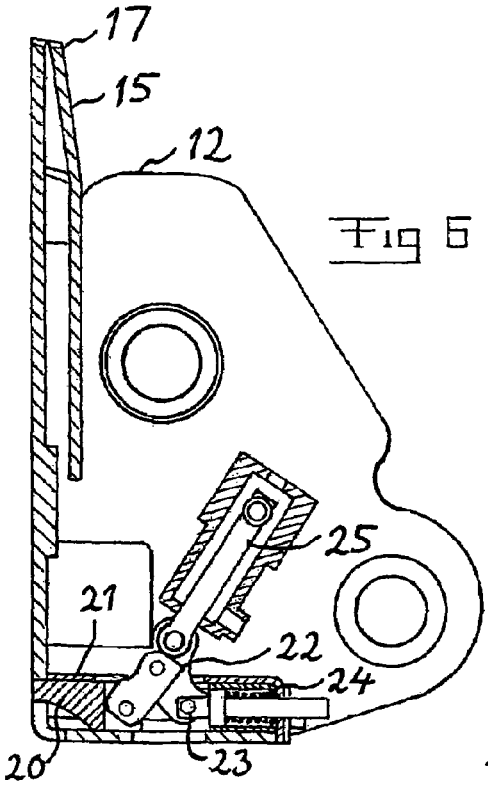
Fig 6
Fig 7
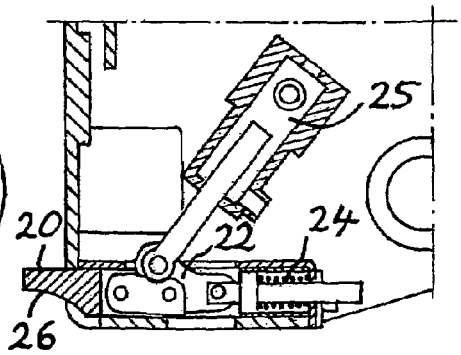

SECURING DEVICE

BACKGROUND OF THE INVENTION AND PRIOR ART

The present invention concerns a first part in the form of an instrument or tool to a second part in the form of a beam or such on a working machine according to the description herein.

The working machine can be of any type and trucks, front loaders, digging machines and demolition machines can be mentioned as examples, which in general are supplied with different types of working instruments or tools. Examples of such instruments are forks of different types, scoops, clamping units, man baskets, lever arms and other special types of equipment for handling special loads.

An attachment device of the type defined in the introduction is usually called "rapid attachment", because the attachment of instruments to the working machine can occur relatively quickly by making said engagement and then utilizing force of gravity to fixedly hold the instrument at the working machine's beam or such. "Engagement" is to be understood to have a broad meaning and can for example mean that hooks on the working instrument are held under the force of gravity and are clamped onto an outer edge of the holding frame of the working machine's beam and the instrument is held against the frame and supported by the frame in some additional position. Such so-called rapid attachments are used for tools and instruments such as scoops, lever arms and other tools, which do not require any separate machine operation of any type. In prior art devices for attaching an instrument or a tool to a beam or such on a working machine according to the preamble of claim 1 there is a risk that the instrument or tool will gradually become more loosely attached on said beam or such because of the effect of the operation of the working machine on the device itself.

SUMMARY OF THE INVENTION

The aim of the present invention is to provide a device of the type defined in the introduction, which remedies the above-mentioned inconveniences associated with such prior art devices.

This aim is achieved according to the invention by providing such a device with the features that are given herein; and By providing the fixedly locking arrangement with resilient members in combination with the wedge element the gap in the attachment will constantly be automatically eliminated, because the resilient member constantly ensures that the wedge element is pushed as far as possible into the recess. Consequently the invention solves the problem effectively using surprisingly simple means.

The wedge element's wedge form is thereby preferably such that the wedge element will be pushed into the recess under the action of the internal walls of the recess in such a direction that the part that is provided with the recess is pushed with its engagement means having surfaces converging towards each other into an engagement-making direction.

According to another preferred embodiment of the invention the device also comprises controllable power means for transferring the locking arrangement between an inactive position and an active position with the wedge element pushed into the recess and held during pre-loading. The wedge element can hereby be held back and is not in the way of the insertion of the first engagement means in the second engagement means and it is then driven to the active locking position via the operation of the power means.

According to another preferred embodiment of the invention the locking arrangement connected with the wedge element comprises, a dead centre defining means, and the power means is designed to influence said dead centre means to transfer the wedge element from an inactive position to an active position located on the opposite side of a dead centre, in which the resilient member is solely responsible for holding the wedge element in the recess. The holding in locking position is hereby very reliable, as it does not depend on the power means being supplied with energy.

Advantageously the wedge element is arranged on the second part, i.e. the working machine, and the recess is arranged on the first part, i.e. the instrument or the tool.

According to a preferred embodiment of the invention the second, female-type engagement means has two opposite walls, converging towards one another, which laterally restrict a channel directed substantially vertically in the normal direction of the first part when attached to the second part and form said converging internal surfaces. Arranging the converging surfaces in this way results in a very stable holding of the first part in the second part. It is thereby advantageous that an internal large surface part of the second engagement means, that is substantially planar, forms the bottom of the canal and contacts an external surface part of the fist engagement means, that is substantially planar, in the locked position. It is especially advantageous if two other walls, at least partly restricting the canal, extend substantially at a right angle relative to the formerly mentioned walls and converge towards each other to form said converging internal surfaces, since such a convergence of two planes lying cross-wise with respect to each other results in a very distinct locked position of the first part in the second part. It is more specially preferred if the other walls are formed from said substantially planar large surface parts.

According to another preferred embodiment of the invention the second, female-type engagement means has an opening intended to be turned towards the other part in a direction substantially perpendicular to the direction of convergence of this engagement means' converging surfaces during the engagement operation to facilitate the insertion of the male-type engagement means in the female-type engagement means. The driver of a working machine can hereby rapidly force the first engagement means into the second and lock the first part at the second part without nerve racking precision work being required.

Further advantages and advantageous features of the invention will be apparent from the following description and the other dependent claims.

BRIEF DESCRIPTION OF THE DRAWINGS

Preferred embodiments of the invention are described below by way of example with reference to the attached drawings, in which:

FIG. 4 is a perspective view of the male-type engagement means according to FIG. 3, FIG. 5 is a perspective view illustrating how the engagement means according to FIG. 4 is intended to be inserted into the engagement means according to FIG. 2 to attach the instrument to the working machine's beam by means of the attachment device according to the invention, FIG. 6 is a view of the locking arrangement included in the inventive device in an inactive position, and FIG. 7 is a view of the locking arrangement according to FIG. 6 in an active locking position.

DETAILED DESCRIPTION OF A PREFERRED EMBODIMENT OF THE INVENTION

Figure 1:
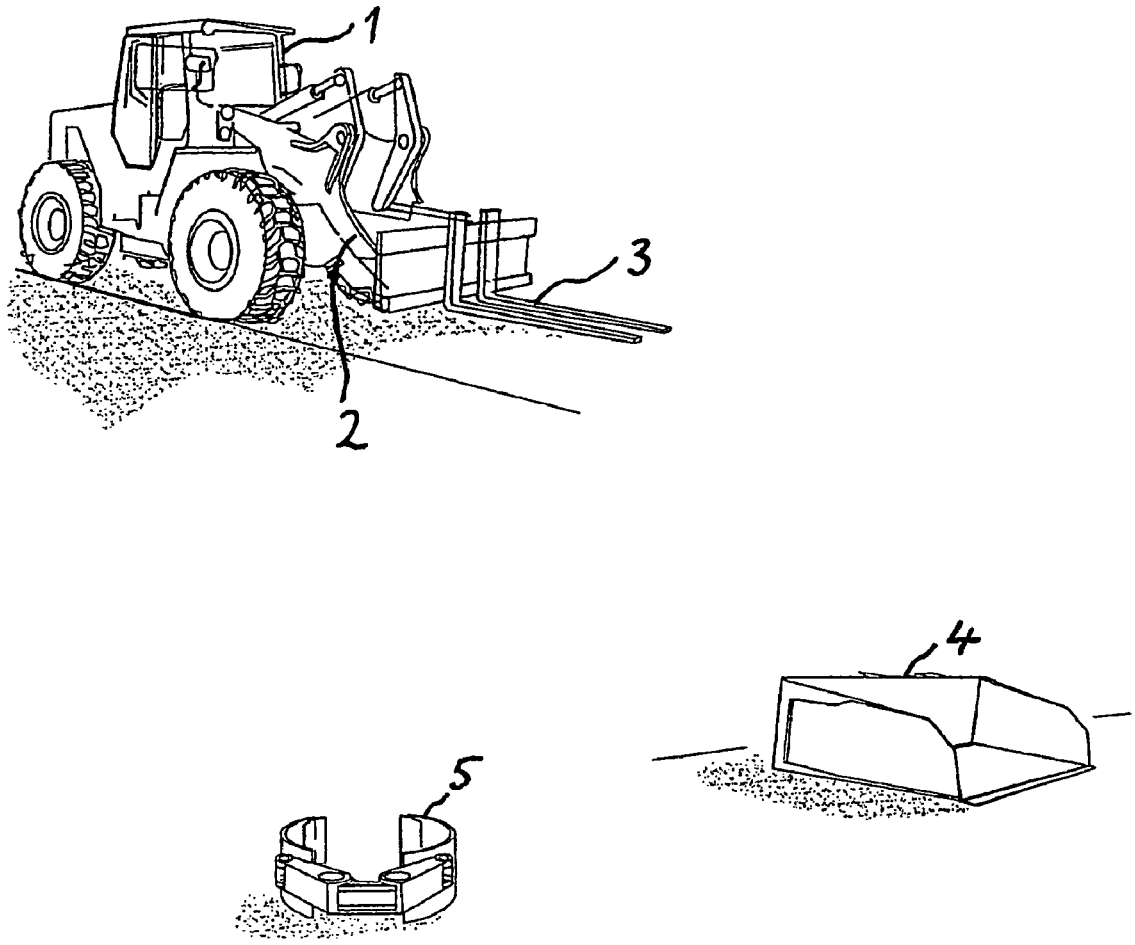
FIG. 1 illustrates very schematically a conventional working machine with examples of some instruments to which the inventive attachment device could be applied.

FIG. 1 illustrates a working machine 1 in the form of a front loader and some of the large number of different possible instruments, which could be attached by the inventive device to the machine's arms 2. A fork unit 3, a scoop 4 and a clamping unit 5 is shown here.

Figure 2:
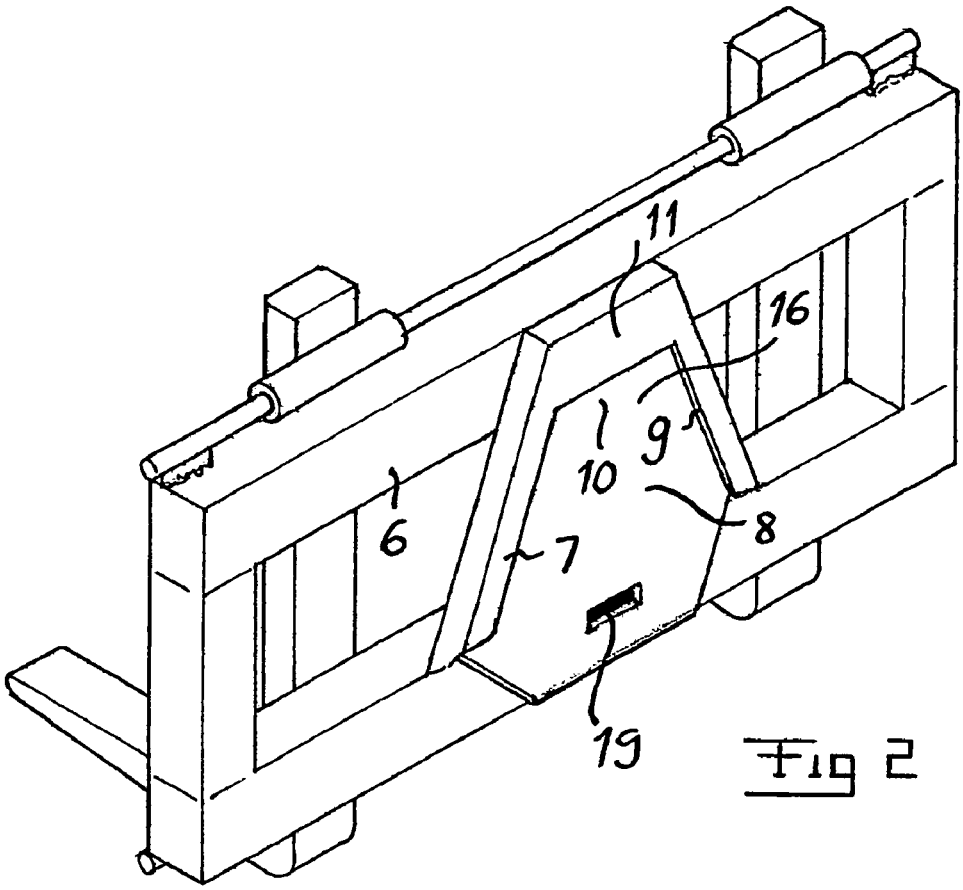
FIG. 2 is a perspective view of a female-type engagement means included in the inventive device fixed on an instrument.

FIG. 2 illustrates part of an attachment device according to a preferred embodiment of the invention, more particularly the part that is intended to be arranged on the instrument. A second, female type engagement means 7 of the inventive attachment device is attached to an attachment frame 6 (that can even be an attachment plate) on the instrument. This engagement means is formed from a metal sheet that is flanged into a suitable form, described below, and attachably welded to the attachment arm 6. More particularly the second engagement means has a large planar surface part 8, that is intended to be directed towards the attachment device part arranged on the beam on attachment of the instrument to a beam or such on the working machine. This planar surface part forms the bottom of channel 10 but is restricted by one of the opposing sidewalls 9. The sidewalls 9 converge upwards towards each other and form internal converging surfaces of the engagement means. The engagement means also has a planar surface part 11, that lies opposite to the large planar surface part, that converges towards the large surface part 8 in the upwards direction in order to form converging internal surfaces of the second engagement means together therewith. This engagement means therefore has channel tapered in the upward direction in two planes that are substantially perpendicular to one another.

Figure 3:
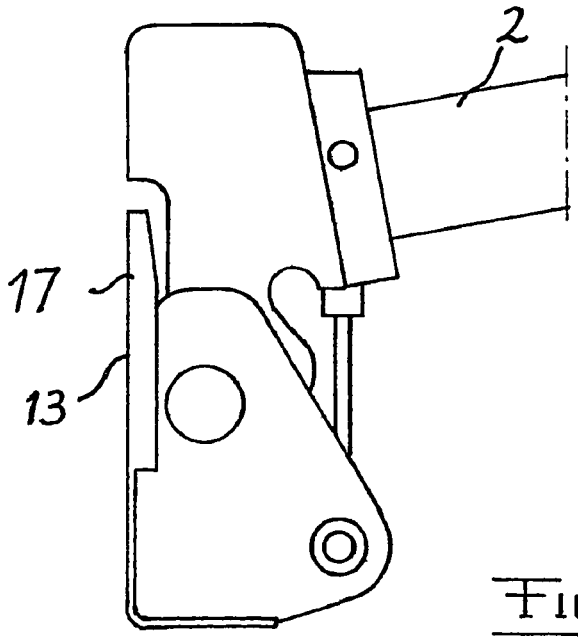
FIG. 3 is a perspective view of an end of a beam of a working machine with a male-type engagement means of the inventive attachment device attached thereon.

FIG. 3 schematically illustrates how a first, male-type engagement means of the attachment device is attached to an attachment frame 12 or such on a working machine's beam or arm. FIG. 4 illustrates the construction of the first, male-type engagement means in more detail. It shows external converging surfaces having a convergence corresponding to the internal converging surfaces of the second engagement means. A large planar surface part 13 intended to be driven into contact with the large planar surface part 8 of the second engagement means to give the instrument good support relative to the beam therefore also exists here. Lateral outer walls 14 converge in the upward direction to the same degree as the sidewalls 9. A surface part 15 extends opposite to the planar surface part 13, so that the surface part 13 and 15 converge upwards to the same degree as the surface parts 8 and 11.

FIG. 5 schematically illustrates how the so-called "docking operation" takes place, i.e. how the instrument is attached to the working machine's beam via an attachment device. The female type engagement means has an opening 16 intended to be directed against the beam on attachment, so that the male type engagement means 17 with its point 18 can be driven somewhat angled into the opening 16 to push against the planar surface part 8. When this position is reached the driver angles the attachment frame 12, and thereby the male type engagement means 17, and then lifts the said means 17 so that it moves into the channel 10 into play-less contact of the external converging surfaces against the internal converging surfaces by means of the force of gravity in two different convergence planes. When this has taken place the instrument is then fixedly locked to the beam via a locking arrangement included in the device, which will now be described with simultaneous reference to FIGS. 6 and 7.

The locking arrangement has, on one hand, a recess 19 in the form of a through-hole arranged in the instrument part, more particularly in the planar surface part 8, and, on the other hand, a locking unit arranged in the working machine's attachment frame 12. The locking unit has a wedge element 20 that is movably controlled via a control means 21 to move out of the frame 12 for insertion into the recess 19 to an active locking position and out of the recess to an inactive position. For this reason the locking element is connected to a dead-centre-defining toggle joint 22, between whose one end 23 and a stop bolt a compression spring 24 is arranged. The locking arrangement even has a power means 25 in the form of a hydraulic cylinder, whose piston rod is connected to the toggle joint device's 22 toggle joint.

The function of the locking arrangement is as follows. When this is in the active position shown in FIG. 6 the wedge element does not project out of the attachment frame 12 and this position is maintained during the insertion of the attachment device's male-type engagement means in the female-type engagement means to the locked position. Thereafter the hydraulic cylinder 25 is controlled to extend and thereby press the toggle joint downwards while compressing the compression spring 24, i.e. while storing potential energy in the spring. This means that the wedge element 20 is pressed into the recess 19. A dead centre of the toggle joint device is thereby passed, so that this can return to the inactive position without the influence of the power means 25. The power means is not therefore required to deliver continuous power to hold the locking arrangement in the active locking position. In this position (see FIG. 7) the compression spring will try to release the maximum amount of potential energy and hold the locking element pushed as far as possible in the recess the whole time. This guarantees a constant play-free locking. The wedge element will also, via its downwardly directed wedge surface 26, constantly force the instrument downwards relative to the beam and thereby push the male-type engagement means upwards in the female-type engagement means and supplement the force of gravity in its holding function.

The inventive device therefore provides the possibility to achieve a play-free attachment and locking of an instrument to a beam or such of a working machine according to the rapid attachment principle, i.e. without the driver having to leave the driver's cabin of the working machine.

The invention is of course not in any way limited to the preferred embodiment described above, but a number of modification possibilities thereof should be apparent for a person skilled in the art without having to deviate from the basic idea of the invention.

For example it would be completely possible to arrange the female-type engagement means on the beam or such and the male-type engagement means on the instrument instead, and these would then have the shape of a V instead of an inverted V.

It is even, in principle, possible for the engagement means to have fewer or more converging surfaces than what has been illustrated above. In principle substantially cone-formed male type engagement means would be possible, even if the above described embodiments are preferred in relation thereto because of the possibility of more simply inserting the female-type means and probably even of attaining a better stability in the attached position.

As regards the use of the words "upward" and "vertical" in this document these words relate to the usual position which the working machine and the instrument have when they are resting on horizontal ground, and departure from said directions will of course occur when the working machine and/or the instrument are/is otherwise directed.

The invention claimed is:

1. Device for attaching a first instrument or tool part (3-5) to a second part (2) in the form of a beam or on a working machine, comprising first (17) and second (7) engagement means respectively fixed to one of the first (3-5) and second (2) parts, said first (17) and second (7) engagement means structured and arranged on the respective parts (2-5) to be driven into engagement with each other such that the parts (2-5) are thereby held attached to each other under the force of gravity of the first part (3-5) upon the second part (2), said first (17) engagement means include a male engagement member having external surfaces (14, 15) converging towards each other, said second (7) engagement means include a female member having internal surfaces (8, 11) converging towards each other in a corresponding way to said external surfaces (14, 15) of said first engagement means (17), to receive and hold said first engagement means (17) in said second engagement means (7) under the influence of the gravitational force of the first part (3-5) upon the second part (2) to push said external converging surfaces (14, 15) substantially in the direction of convergence against said internal converging surfaces (8, 11) and into a fixed position in which said respective externally (14, 15) and internally (8, 11) converging surfaces fit tightly together, and an arrangement to fixedly lock the second part (2) to the first part (3-5) and with a recess (19) in a surface (8) of one (3-5) of the parts (2-5), and comprising a wedge element (20) movably arranged on the other (2) of the parts (2-5), means (25) for inserting said wedge element (20) in the recess (19) such that surfaces of said wedge element (20) are pressed against walls of the recess (19) and locking said wedge element (20) non-movably in the recess (19), resilient means (24) arranged to be compressed, store potential energy and only act on said wedge element (20) to press said wedge element (20) into the recess (19) during biasing of said resilient means (24) by said inserting means (25) in said locked position, and not act upon said wedge element (20) in absence of such biasing by said inserting means (25), such that said wedge element (20) remains retracted, and said inserting means (25) are positioned between said wedge element (20) and said resilient means (24).

2. Device according to claim 1, wherein the wedge-element (20) is, on pressing into the recess (19), designed to fit against and influence the internal walls of the recess in such a direction that the part provided with the recess is pressed with its engagement means (7) having surfaces converging towards each other into an engagement-making direction.

3. Device according to claim 1, wherein said engagement means comprises a controllable power means (25) for transferring the locking arrangement between an inactive position and an active position with the wedge element (20) pushed into the recess (19) and held during pre-loading.

4. Device according to claim 3, wherein the locking arrangement comprises a dead centre defining means (22) connected to the wedge element (20), and the power means (25) are designed to influence said dead centre defining means to transfer the wedge element from an inactive position to an active position located on the opposite side of a dead centre, in which the resilient member (24) is solely responsible for holding the wedge element in the recess.

5. Device according to claim 1, wherein the recess (19) is a through hole.

6. Device according to claim 1, wherein the wedge element (20) is arranged on the second part (2) and the recess (19) on the first part (3-5).

7. Device according to claim 1, wherein the first engagement means has an external, substantially planar, large surface part (13) arranged to fit against an internal, substantially planar, large surface part (8) of the second engagement means in locked position to support the first part relative to the second part in the direction of these surface parts.

8. Device according to claim 7, wherein said large, planar surface part on the engagement means on the first part is arranged to be directed substantially opposite to the direction for nearing the second part to the first for said attachment.

9. Device according to claim 1, wherein the second engagement means (7) has two opposing walls (9) that converge towards each other, which laterally restrict a channel (10) directed substantially vertically in the normal position of the first part when attached to the second part and form said converging internal surfaces.

10. Device according to claim 9, wherein both of said converging channel walls (9) form opposing boundaries on the substantially planar support surface part (8) that forms the bottom of the channel.

11. Device according to claim 10, wherein the second engagement means (7) have a planar surface part (11) lying opposite to said large, planar surface part (8) and converging towards the latter to form said converging internal surfaces together therewith.

12. Device according to claim 9, wherein the second engagement means (7) comprises two other walls (8, 11), which at least partly restrict the channel (10) and extend substantially perpendicularly relative to the firstly mentioned walls (9) and converge towards each other to form said converging internal surfaces.

13. Device according to claim 1, wherein the second engagement means (7) has an opening (16) intended, to be turned towards the other part during the engagement operation in a direction that is substantially perpendicular to the direction of convergence of the converging surfaces thereof to facilitate the insertion of the first engagement means (17) in the second engagement means.

14. Device according to claim 1, wherein the second engagement means (7) is formed from a flanged metal sheet.

15. Device according to claim 1, wherein the second engagement means (7) is arranged on the first part (3-5) with upwardly converging internal surfaces and the male-type engagement means (17) is arranged on the second part (2) with upwardly converging external surfaces.

16. Device according to claim 2, wherein said engagement means comprises a controllable power means (25) for transferring the locking arrangement between an inactive position and an active position with the wedge element (20) pushed into the recess (19) and held during pre-loading.

17. Device according to claim 2, wherein the first engagement means has an external, substantially planar, large surface part (13) arranged to fit against an internal, substantially planar, large surface part (8) of the second engagement means in locked position to support the first part relative to the second part in the direction of these surface parts.

18. Device according to claim 3, wherein the first engagement means has an external, substantially planar, large surface part (13) arranged to fit against an internal, substantially planar, large surface part (8) of the second engagement means in locked position to support the first part relative to the second part in the direction of these surface parts.

19. Device according to claim 4, wherein the first engagement means has an external, substantially planar, large surface part (13) arranged to fit against an internal, substantially planar, large surface part (8) of the second engagement means in locked position to support the first part relative to the second part in the direction of these surface parts.

20. Device according to claim 1, wherein said inserting means (25) comprise a toggle joint (22) arranged between said resilient means (24) and wedge element (20) to simultaneously extend said wedge element (20) and bias and compress said resilient means (24) in said locked position.

21. Device according to claim 1, wherein said resilient means (24) and wedge element (20) are structured and arranged with respect to one another such that said resilient means (24) are compressed in a direction opposite to insertion direction of said wedge element (20) into the recess (19) and extended when said wedge element (20) is retracted away from the recess (19) and towards the resilient means (24).

22. Device according to claim 21, wherein said wedge (20) and resilient means (24) are both movable along the same axis.

23. Device according to claim 20, wherein said toggle joint (22) comprises two members pivotally coupled together, a first member engaged with said wedge element (20) and a second element engaged with said resilient means (24) which is a compression spring, such that when said members pivot away from one another to form an increasing obtuse angle, said resilient means (24) is compressed and said wedge element (20) extended into the recess (19).

24. Device according to claim 23, wherein when said members form an approximately right angle, said wedge (20) is retracted from the recess (19) and compression spring (24) extended in unbiased condition, and when said members form an approximately 180° angle, said wedge (20) is extended into the recess (19) and compression spring (24) compressed.

25. Device according to claim 23, wherein said inserting means (25) additionally comprise controllable power means (25) for pivoting said members against the force of the compression spring (24) from an inactive, retracted position of said wedge element (20) out of the recess (19) to an active position on an opposite side of a dead center in which extensive force of said compression spring (24) is solely responsible for holding said wedge element (20) in the recess (19).

26. Device according to claim 25, wherein said power means (25) are an hydraulic cylinder having a piston rod connected to said toggle joint (22).

27. Device according to claim 20, wherein said inserting means (25) are structured and arranged to act upon said toggle joint (22) by linear, translational movement towards said toggle joint (22).

* * * * *